United States Patent [19]

Schwemmer

[11] 4,350,000

[45] Sep. 21, 1982

[54] CROWNER NOISE SHIELD

[75] Inventor: Leonard J. Schwemmer, Erie, Pa.

[73] Assignee: Lord Corporation, Erie, Pa.

[21] Appl. No.: 243,288

[22] Filed: Mar. 13, 1981

[51] Int. Cl.[3] ..... B65B 7/28; G10K 11/00

[52] U.S. Cl. ..... 53/287; 53/306; 181/200; 181/205

[58] Field of Search ..... 181/200, 202, 205; 53/287, 306

[56] References Cited

U.S. PATENT DOCUMENTS 3,905,444 9/1975 Evans, Jr. ..... 181/200

4,093,066 6/1978 Mitchell et al. ..... 181/200 X

*Primary Examiner*—L. T. Hix

*Assistant Examiner*—Thomas H. Tarcza

*Attorney, Agent, or Firm*—Thomas L. Kautz

[57] ABSTRACT

An acoustic enclosure is provided having top, bottom, front, side and back panels formed to receive and enclose the face plate and chute of a crowner machine. Acoustically absorbant and cleanable material is disposed on the interior surfaces of the side portions to absorb sound produced at the crowner face plate and chute, and the edges of the enclosure abutting the crowner machine include a material for creating a seal therebetween to further reduce the sound level in the immediate area.

7 Claims, 5 Drawing Figures

CROWNER NOISE SHIELD

FIELD OF INVENTION

The subject invention relates generally to acoustic enclosures, and, more specifically, to a device for acoustically enclosing the face plate and chute of a crowner machine.

BACKGROUND OF THE INVENTION

A primary source of noise in the bottling of soft drinks, beer and other beverages is the crowner machine which caps and seals the bottles after filling. Each of the three most widely used crowners includes a hopper, crowner face plate and crowner chute. Crowns are loaded in bulk into the hopper section and then introduced into the crowner face plate where they are properly oriented. The crowns are forced downwardly from the face plate along the crowner chute to the bottles for installation. To assure smooth operation of the crowner at economic production speeds, it has been found necessary to agitate the crowns within the hopper to avoid bunching or wedging prior to their introduction into the crowner face plate. In addition, some means must be provided to force the crowns downwardly along the crowner chute toward the bottles to be capped.

Agitation and movement of the crowns is normally accomplished by pressurized air forced through nozzles selectively located adjacent the point of connection between the hopper and crowner face plate, and along the length of the crowner chute. While assuring smooth handling and movement of the crowns, such air jets generate noise levels near the crowner in the range of 90 to 110 dBA. Such noise levels, if not physically harmful to the hearing, are at least distracting and uncomfortable to workers in the surrounding area.

In an effort to reduce the noise levels associated with the crowner air jets, at least two solutions have been proposed. First, mechanical agitation means have been provided at the hopper, face plate and/or crowner chute in combination with existing air jets to permit a reduction in the pressure of air forced through the jet nozzles which results in an accompanying reduction of the noise level. A second approach involves the use of silenced thrust nozzles with the same air pressure level as in existing devices. Generally, it has been found that the combination of mechanical and air agitation means is costly and difficult to retrofit to existing machines. While silenced thrust nozzles appear to be less costly and more easily retrofitted than the mechanical-air agitation means, such nozzles have proved to be relatively ineffective in reducing the crowner noise levels to any appreciable extent.

SUMMARY OF THE INVENTION

The subject invention provides an acoustic enclosure adapted to fit over the face plate and chute portion of the crowner, which is relatively inexpensive, easily retrofitted to existing crowners and achieves a reduction in the air noise associated with the most widely used crowners by as much as 10–12 dBA. Instead of approaching the crowner air noise problem by attempting to alter the source of the noise as in prior art designs, the subject invention simply encloses those portions of the crowner which contain the air nozzles with a sound-absorbing structure. This enables the air introduced into the jet nozzles to be pressurized at a level which assures proper operation of the crowner while achieving acceptable noise reduction.

The acoustic enclosure herein consists of at least one generally rectangular-shaped structure including a top, bottom, two side sections and a back section formed with an opening for receiving the crowner face plate and crowner chute. The side portions of the enclosure are provided with an acoustically absorbent and cleanable material, and fit directly against the housing the crowner. The front section or panel of the acoustic enclosure is a hinged door, preferably formed of a transparent material such as transparent plastic or glass, which provides access to the crowner face plate and chute for cleaning, repairs or visual inspection. The dimensions and shape of each of the panels forming the acoustic enclosure herein may be altered to suit a particular application and facilitate retrofitting to existing crowner devices.

Therefore, it is an object of the present invention to provide an acoustic enclosure for reducing the noise levels associated with the air jets in a crowner device.

It is a further object herein to provide an acoustic enclosure having a top, bottom, two side sections and a back section formed to receive the face plate and chute of a crowner machine.

It is another object of the subject invention to provide an acoustic enclosure for a crowner machine having at least two side surfaces on which cleanable, acoustically absorbent material is removably disposed.

It is a still further object herein to provide an acoustic enclosure, generally rectangular in shape, having a front section which is hinged at one side and formed of suitable transparent material to provide access within the enclosure and permit visual inspection.

DESCRIPTION OF THE DRAWINGS

Objects in addition to the foregoing will become apparent upon consideration of the following description considered in conjunction with the accompanying drawings wherein.

DETAILED DESCRIPTION OF THE INVENTION

Figure 1:
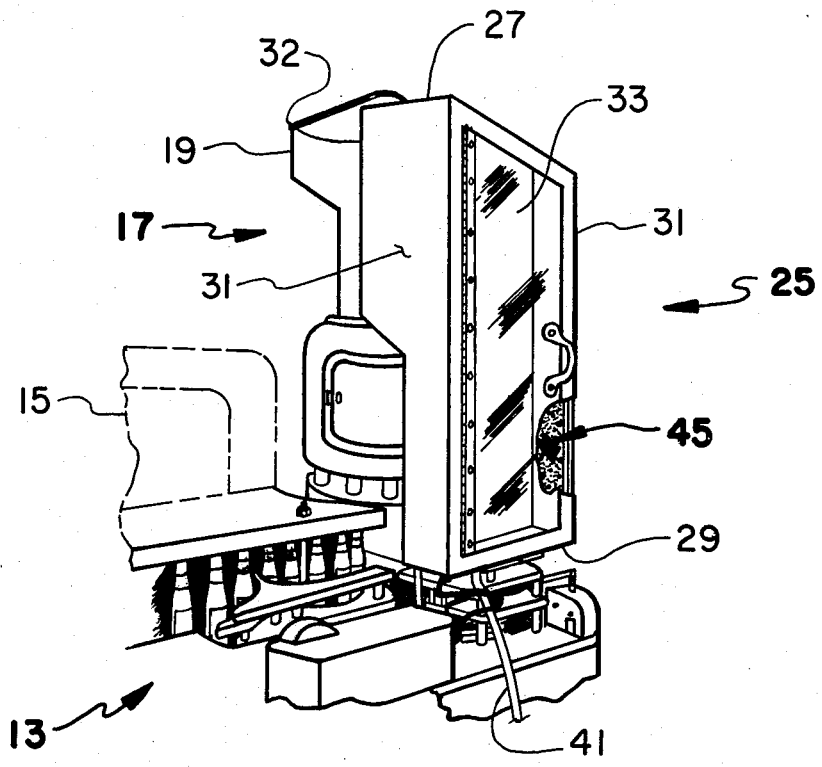
FIG. 1 is a perspective view of the acoustic enclosure herein installed on a typical crowner machine in a bottling line.
Figure 2:
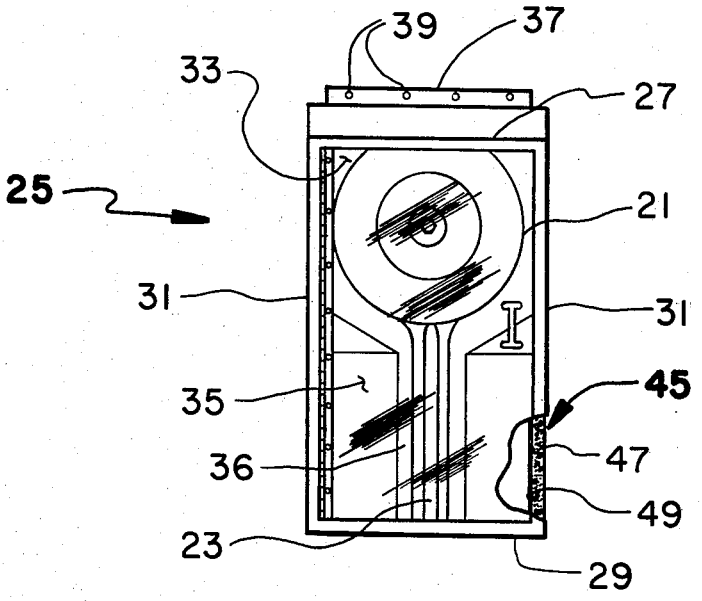
FIG. 2 is a front view of the acoustic enclosure of the subject invention showing the configuration of the back section.

Referring now to the drawings, and in particular to FIGS. 1 and 2, a portion of a typical bottling line is shown including an empty bottle conveyor 13, bottle filler 15 and crowner machine 17. The crowner 17 includes a hopper 19 connected to a crowner face plate 21, and a crowner chute 23 which extends from the face plate 21 downwardly to a point immediately above the bottles to be capped. Crowns are loaded in bulk into the hopper 19 and enter the crowner face plate 21 where they are properly oriented. From the face plate 21, the crowns are guided to a position for installation on the bottles by the crowner chute 23.

As mentioned above, air jets (not shown) are provided adjacent the point of connection between the hopper 19 and face plate 21 to agitate the crowns and thus assure their separation as they move from the hopper 19 to the face plate 21. Without such agitation, the crowns could bunch up and wedge together causing the crowner 17 to jam. In addition, a series of air jets (not shown) are disposed at selected intervals along chute 23 to force the crowns from the face plate 21 to the opposite end of chute 23. The sound produced by such air jets has been measured at levels of 90 to 110 decibels in the area immediately adjacent to the crowner. Such noise levels are unacceptable.

In the discussion above, it was noted that prior known attempts to reduce the air noise produced by crowners such as that shown in FIG. 1 generally involve some form of alternate design of the noise source. Such attempts include the use of silenced thrust nozzles for the air jets and the addition of mechanical agitation means to existing air jets to allow for a reduction in air pressure. The limitations of these solutions have been detailed above.

The approach to the reduction of crowner air noise provided by the subject invention is to simply enclose the air jets creating the noise with a sound-absorbing structure. One embodiment of an acoustic enclosure according to the present invention is shown in FIGS. 1 and 2 and labelled generally with the reference 25. Enclosure 25 is generally rectangular in shape with a top panel 27, bottom panel 29, two side panels 31, a front panel 33 and a back panel 35. With the exception of front panel 33, enclosure 25 may be fabricated of corrosive resistant steel such as stainless steel or a suitable equivalent having a thickness in the range of 0.03–0.06 inches. Plastic in the range of 0.125–0.25 inches thick may also be utilized if desired.

The top panel 27 is closed but may be sloped at a slight angle for aesthetics and cleanability. An elongated bracket 37 formed with a plurality of holes 39 disposed at spaced intervals therealong is attached to top panel 27 and provides a means for mounting enclosure 25 to the surface of crowner 17. The bottom panel 29 is also a continuous surface but may be provided with openings for clearance of the chute 23 or chute appurtenances depending on the particular configuration of the crowner 25. In the event a crown washer is provided as part of the crowner 25, the bottom panel 29 may be sloped for drainage and provided with an opening to receive a drain hose 41.

The side panels 31 are attached to the top 27 and bottom 29 panels by welding or mechanically-fastened by any other suitable means, and are formed in a generally L-shaped configuration as shown in FIG. 1. The edges 32 of side panels 31 adjacent back panel 35 are formed to abut crowner 17 and preferably have a flexible edge seal of vinyl or a suitable equivalent to create a seal between enclosure 25 and crowner 17. The surfaces of side panels 31 which face inwardly within enclosure 25 are provided with clips of other suitable fastening means (not shown) to removably secure a layer 45 of acoustically absorbent material thereto. The acoustically absorbent layer 45 is preferably formed of acoustic foam 47 having a thickness of approximately one inch, which is completely encapsulated in a sealed acoustically transparent film 49. Air noise generated by the crowner 17 air jets is thus partially absorbed by the absorbent layer 45 and prevented from escaping enclosure 25, at least to some degree, by the seal created between side panels 31 and crowner 17. The transparent film 49 protects the acoustic foam 47 from damage due to moisture of air-borne contaminants, and permit sanitation of the crowner 17.

The back panel 35 of enclosure 25 includes an opening 36 which is formed to receive the crowner face plate 21 and chute 23. This enables side sections 31 to fit tightly against the crowner 17 for enhancing the seal between crowner 17 and enclosure 25. Depending on the particular configuration of crowner 17, the opening 36 in back panel 35 may be easily altered to accommodate the face plate 21 and chute 23.

Finally, the embodiment of enclosure 25 shown in FIG. 1 includes a front panel 33 which is hinged on one side to permit access within enclosure 25. The edges of front section 33 preferably include a flexible seal formed of vinyl or an equivalent to reduce the escape of air noise from enclosure 25. A retaining means to maintain front section 33 in a closed position is also provided which may be a magnetic strip/vinyl seal or an equivalent. The front section 33 is preferably formed of a material such as transparent plastic or safety glass to permit visual inspection of crowner face plate 21 and chute 23. Although shown as a continuous surface, front panel 33 may be formed in two or more individual sections to permit separate access to the crowner face plate 21 and chute 23, for example, without departing from the scope of the subject invention.

Figure 3:
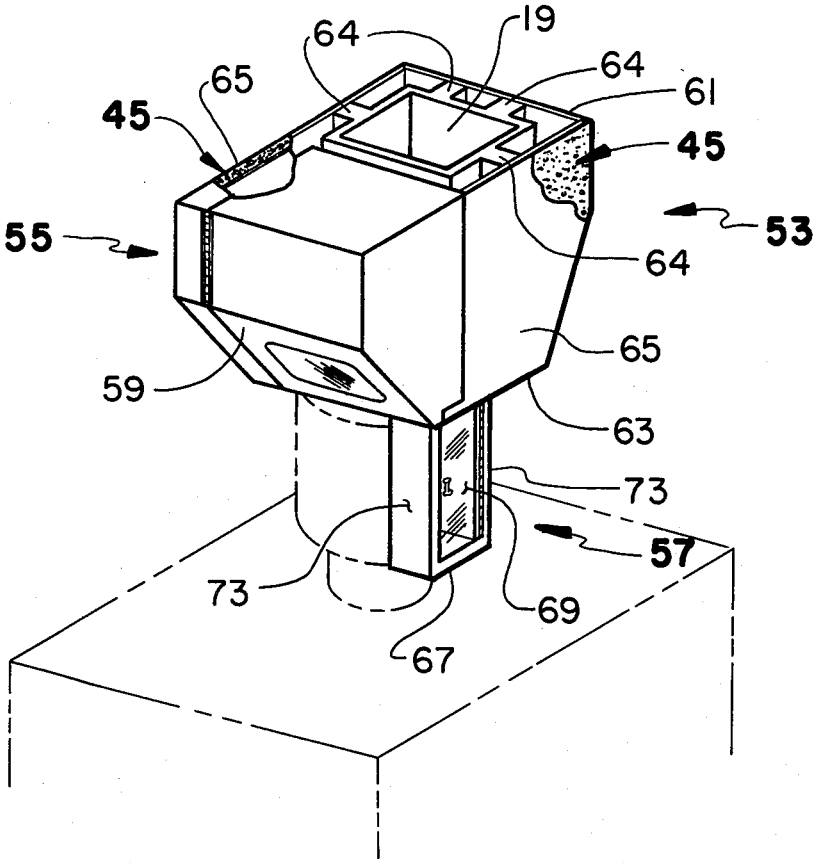
FIG. 3 is a perspective view of an alternate embodiment of the subject invention.
Figure 4:
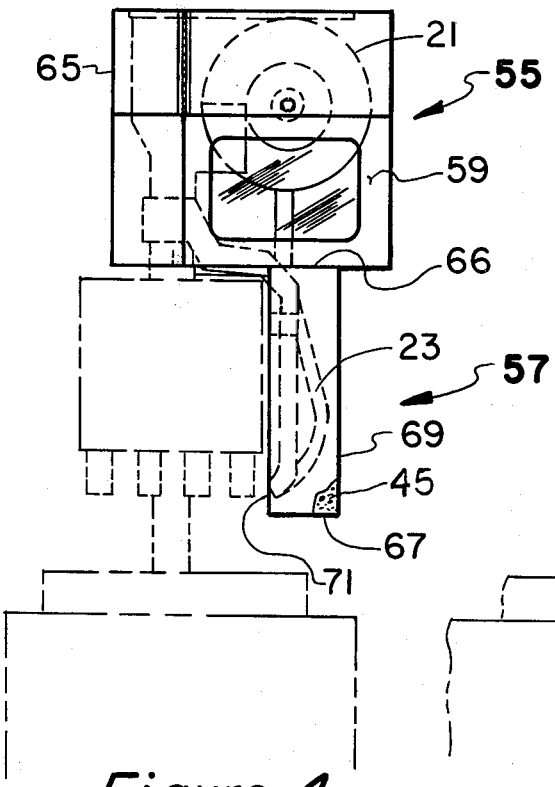
FIG. 4 is a side view of the embodiment of the subject invention shown in FIG. 3.
Figure 5:
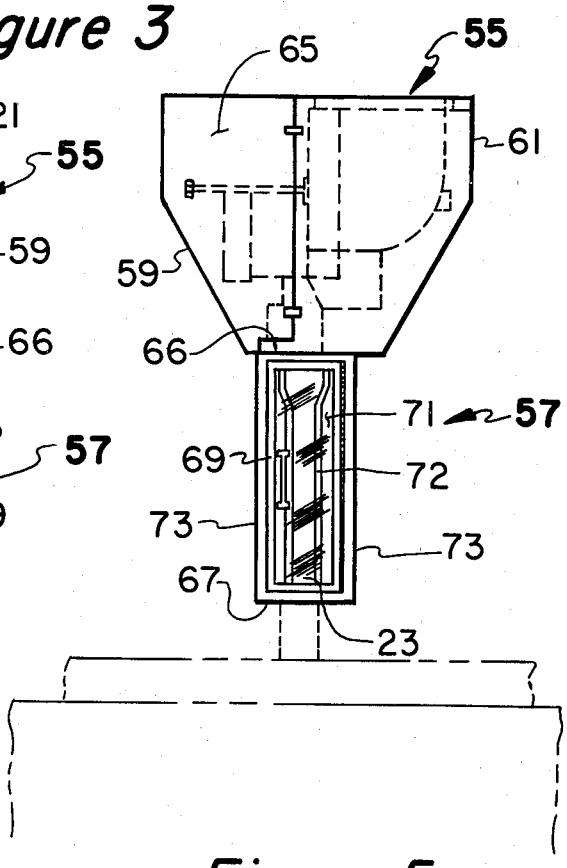
FIG. 5 is a front view of the embodiment herein shown in FIG. 3.

Referring now to FIGS. 3 to 5, an alternate embodiment of the acoustic enclosure herein is shown and labelled generally with the reference 53. Acoustic enclosure 53 is intended to accommodate a different crowner machine design than shown in FIG. 1 in which the face plate 21 is mounted on one side of the hopper 19, and the chute 23 extends downwardly from face plate 21 along the front of the crowner machine. As is apparent from FIGS. 1 and 2, the face plate 21 and chute 23 of crowner machine 17 are disposed in alignment with one another on the same side of crowner machine 17.

The objective of acoustic enclosure 53 is the same as that for enclosure 25, that being to cover the air jets along chute 23 and at the hopper 19—face plate 21 interface with a sound-absorbing structure. Since the face plate 21 and chute 23 are located on different sides of the crowner machine shown in FIGS. 3–5, the acoustic enclosure 53 consists essentially of a separate upper section 55 and lower section 57. The upper section 55 is mounted to the crowner machine at a location just below face plate 21 and extends upwardly to enclose both the face plate 21 and hopper 19. The upper surface of lower section 57 engages the bottom surface of upper section 55 and extends downwardly to enclose the chute 23. As discussed more fully below, the upper and lower sections 55 and 57 are separate structures and will be installed and mounted to the crowner machine individually.

The upper section 55 has a front panel 59, back panel 61, bottom panel 63 and side panels 65 connected together by welding or mechanically fastened by any other suitable means. As is apparent from FIG. 3, upper section 55 completely encloses the hopper 19 (except for its top surface), unlike the acoustic enclosure 25 shown in FIGS. 1 and 2. The inwardly extending edges of bottom panel 63 are covered with a flexible edge seal of vinyl or an equivalent for sealing engagement with the crowner machine at the base of hopper 19. The front panel 59, back panel 61 and side panels 65 are attached to housing brackets 64 provided on the upper edge of hopper 19 for securing upper section 55 in place. As shown in FIGS. 3 and 4, at least a portion of front panel 59 is formed of a transparent plastic or safety glass to permit inspection of face plate 21. Front panel 59 is also hinged at one side to provide easy access within upper section 55 for maintenance or clearing of face plate 21 and hopper 19. Where space permits, the interior surfaces of back panel 61 and side panels 63 are covered with a layer 45 of acoustically absorbent material for at least partial absorption of the sound produced by the air jets located at the point of connection between the hopper 19 and face plate 21.

The lower section 57 is similar to acoustic enclosure 25 of FIGS. 1 and 2, except that it encloses only the chute 23 and the air jets disposed therealong. Lower section 57 includes a top panel 66, bottom panel 67, front panel 69, back panel 71 and side panels 73. As in acoustic enclosure 25, the interior surfaces of side panels 73 of lower section 57 includes clips to removably secure an acoustically absorbent layer 45 thereto. The edges of side panels 73 adjacent back panel 71 are formed to abut the crowner machine and may be covered with vinyl to create a seal between lower section 57 and the crowner machine. The top panel 66 engages the bottom panel 63 of upper section 55 to give acoustic enclosure 53 the appearance of being a continuous structure. As with the bottom panel 29 of acoustic enclosure 25, the bottom panel 67 of lower section 57 may be sloped downwardly from the back panel 71 to the front panel 69 for drainage of any moisture which may accumulate therein.

The back panel 71 of lower section 57 is formed with an opening 72 to receive chute 23 for enclosure within lower section 57. The size and shape of opening 72 may be varied as required to accommodate different configurations of chute 23 or chute appurtenances. Finally, front panel 69 may be formed of material such as transparent plastic, safety glass or an equivalent to permit inspection of chute 23. In addition, one edge of front panel 69 is hinged to provide access within lower section 57 for cleaning and maintenance of chute 23. Flexible seal means is provided at the panel edges to maintain front panel 69 in a closed position.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. In a crowner machine including a face plate, chute and crown advancing means, said crown advancing means producing high levels of noise, the improvement comprising:

an acoustic enclosure for absorbing at least a portion of the noise produced by the crown advancing means, said acoustic enclosure including top, bottom, front, back and two side panels connected together, at least one of said panels having sound-absorbing material removably mounted thereto, said back panel being formed with an opening to receive the face plate, chute and crown advancing means, said panels being adapted to engage the surface of said crowner machine, said acoustic enclosure being mounted to said crowner machine so that the face plate, chute and crown advancing means are received within said opening in said back panel as said panels engage the surface of said crowner machine thereby entirely enclosing the face plate, chute and crown advancing means within said acoustic enclosure for maximum absorption of noise.

2. An acoustic enclosure for reducing the noise produced by a crowner machine, said crowner machine including a hopper, a face plate mounted to said hopper, a chute and means for advancing crowns from said hopper to said face plate and along said chute, said acoustic enclosure comprising an upper and lower section, said upper section including front, back, bottom and side sections connected together for mounting to said hopper and enclosing said face plate of said crowner machine, said front panel of said upper section having a transparent portion to permit inspection of said face plate and crown advancing means and being moveable to provide access thereto, said lower section including top, bottom, front, back and side panels connected together for mounting to said crowner machine, said back panel being formed with at least one opening to receive said chute and crown advancing means for enclosure within the interior of said lower section, and said front panel of said lower section having a transparent portion to permit inspection of said chute and being moveable to provide access to said crowner machine.

3. The acoustic enclosure of claim 2 wherein the edges of said side panels adjacent said back panel of said lower section include sealing means for engagement with said crowner machine to reduce the escape of noise from said acoustic enclosure.

4. The acoustic enclosure of claim 2 wherein said bottom surface of said upper section includes inwardly extending edges having sealing means for engagement with the lower portion of said hopper.

5. The acoustic enclosure of claim 2 wherein said side panels of said upper and lower sections include sound absorbing material removably mounted thereto for absorbing sound produced by said crowner machine.

6. The acoustic enclosure of claim 2 wherein said bottom panel of said lower section slopes downwardly at an angle from said back surface to said front surface to provide drainage of any liquid introduced into said acoustic enclosure.

7. An acoustic enclosure for reducing the noise produced by a crowner machine, said crowner machine including a hopper, a face plate mounted to said hopper, a chute and means for advancing crowns from said hopper to said face plate and along said chute, said acoustic enclosure comprising an upper and lower section, said upper section including front, back, bottom and side sections connected together for mounting to said hopper and enclosing said face plate of said crowner machine, said bottom surface including edges extending inwardly adjacent the lower end of said hopper having sealing means for engagement thereto, said back, front and side sections being attached to the upper end of said hopper, said front panel of said upper section having a transparent portion to permit inspection of said face plate and crown advancing means and being moveable to provide access thereto, said lower section including top, bottom, front, back and side panels connected together for mounting to said crowner machine, said back panel being formed with an opening to receive said chute and crown advancing means for enclosure within the interior of said acoustic enclosure, said side panels having sealing means along their edges adjacent said back panel for sealing engagement with said crowner machine, the surfaces of said side panels disposed within the interior of said lower section having sound absorbing material removably mounted thereto for at least partially absorbing the sound produced by said crowner machine, said said front panel of said lower section having a transparent portion to permit inspection of said chute and crown advancing means and being moveable to provide access thereto.

* * * * *